United States Patent [19]

Mitsuyama

[11] Patent Number: 4,920,673

[45] Date of Patent: May 1, 1990

[54] CARD HOLDER

[76] Inventor: Masuhiro Mitsuyama, 1071, Kinugasa, Wake-cho, Wake-gun, Okayama, Japan

[21] Appl. No.: 175,247

[22] Filed: Mar. 30, 1988

[30] Foreign Application Priority Data

Oct. 23, 1987 [JP] Japan ..... 62-162872[U]

[51] Int. Cl.[5] ..... B42F 5/00

[52] U.S. Cl. ..... 40/405; 40/124.4

[58] Field of Search ..... 40/124.2, 124.4, 405, 40/373, 537; 150/147, 145, 148, 149

[56] References Cited

U.S. PATENT DOCUMENTS

| | | | |
|---|---|---|---|
| 2,226,976 | 12/1940 | Leaming | 40/405 |
| 3,270,449 | 9/1966 | Robbie | 40/537 |
| 4,016,664 | 4/1977 | Kaufmann | 40/159 |
| 4,105,057 | 8/1978 | Baumann et al. | 150/147 |
| 4,571,867 | 2/1986 | Williams | 40/124.4 |

FOREIGN PATENT DOCUMENTS

| | | | |
|---|---|---|---|
| 483975 | 4/1938 | United Kingdom | 40/405 |

*Primary Examiner*—Cary E. Stone

*Attorney, Agent, or Firm*—Wenderoth, Lind & Ponack

[57] ABSTRACT

A card holder for housing therein telephone cards or the like, comprising a plate-like base member with pairs of slits through which the cards are insertably housed in the transparent holder so that they are easy to distinguish and to remove. The top ends of each pair of slits are spaced apart at a distance slightly larger than the length of one side of the card. The slits bend downwardly near the top ends and extend therefrom downwardly and inwardly towards each other and approach the opposite ends. Two corners of the card are inserted into a pair of slits, whereby the card holder holds the cards in such a manner as to allow the card to be freely inserted and removed. The pairs of slits are spaced such that the cards do not overlap and are entirely visible. A retaining tongue is provided above each pair of slits to secure the cards in place.

2 Claims, 2 Drawing Sheets

CARD HOLDER

FIELD OF THE INVENTION

The present invention relates to a card holder for housing therein various cards, and more particularly to a card holder suitable for housing therein a plurality of cards.

BACKGROUND OF THE INVENTION

Various cards, for example, telephone cards, when sold at a store, cannot be overlapped because patterns on the cards must be visible, whereby it requires a large space to display them in a plane.

Also, there is the problem in that the telephone cards, when carried or collected to be held, take much time to select the kind or pattern of the card when overlapped.

Furthermore, when a person carries the cards, the person usually puts them in a pocket or purse or commutation ticket holder, but the cards are entirely contained in the pocket, thereby creating the problem in that the card is hard to be smoothly slipped in or out of the pocket.

OBJECT OF THE INVENTION

A first object of the invention is to provide a card holder which can efficiently house the cards in the state where patterns on the surface of each card are visible and which can allow one to stock the cards in a space-saving manner.

A second object of the invention is to provide a card holder which is easy to slip in or out the cards housed therein and also easy to distinguish the kinds of cards or the patterns thereof.

A third object of the invention is to provide a card holder which is easy to slip in or out the cards and convenient to carry them.

These and other objects of the invention will become more apparent in the detailed description and examples which follow.

DETAILED DESCRIPTION OF THE INVENTION

Figure 1:
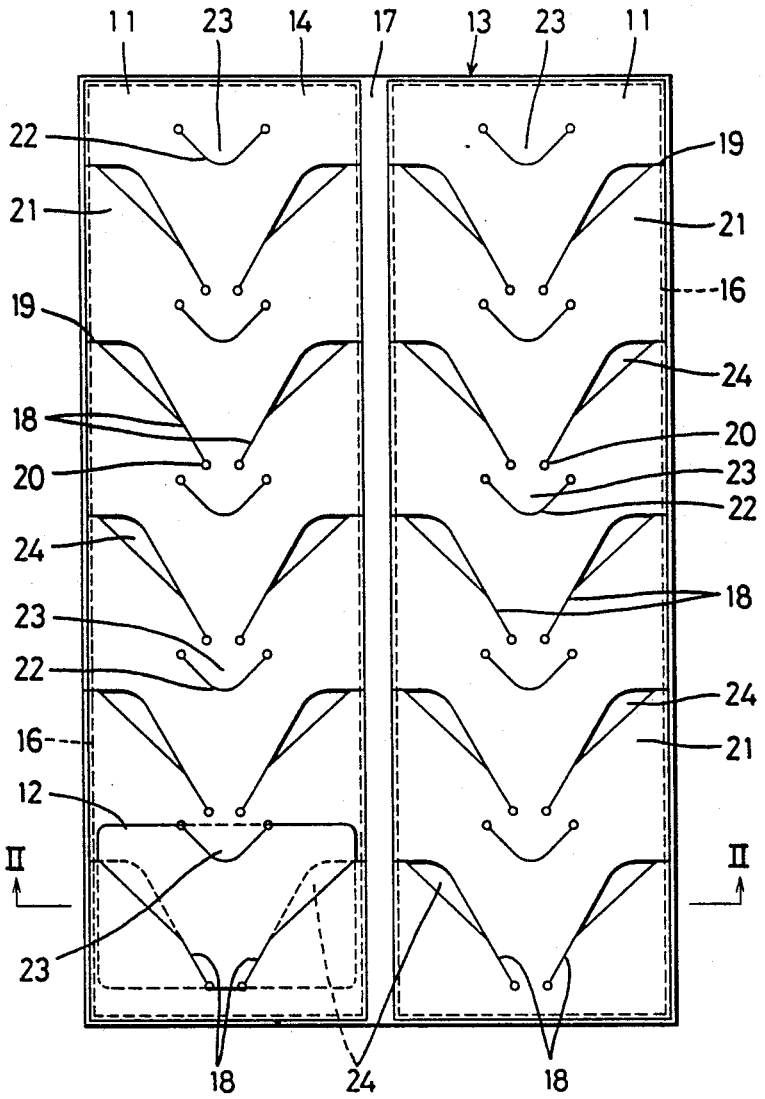
FIG. 1 is a front view of a first embodiment of a card holder of the invention in its opened condition.
Figure 3:
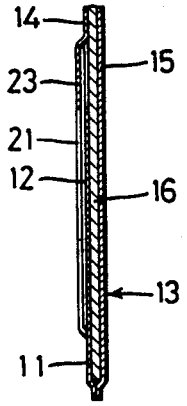
FIG. 3 is an enlarged sectional view of a plate-like base of the FIG. 1 embodiment.
Figure 2:
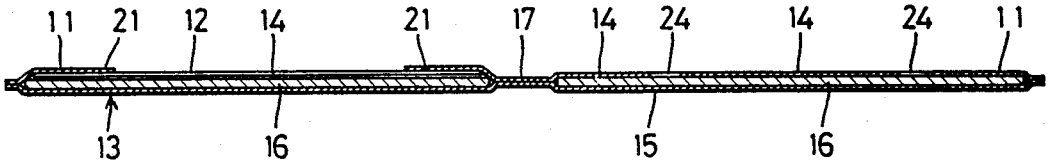
FIG. 2 is a sectional view taken on the line II—II of FIG. 1.

FIGS. 1 through 3 show the first embodiment of a card holder of the invention, which comprises two platelike bases 11 longitudinally long and connected to each other. The card holder is foldable in two so that the cards 12 are contained on the overlapped surfaces of the bases 11 when the card holder is folded in two.

The card holder 13 is so constructed that two longitudinally long synthetic resin sheets 14 and 15 are put together and high-frequency welded at the four side edges and the longitudinal central portion 17 so that cores, such as cardboard, 16 are interposed into the hollow portion formed between the sheet 14 and 15 on both sides of the longitudinal central welded portion, thereby forming two platelike bases 11 in which are foldable.

Each plate-like base 11 is provided on the sheet 14 which is positioned on the inside of the base when folded with pairs of slits 18 disposed vertically in several rows for insertably holding the cards 12.

Each pair of slits 18, as shown in FIG. 1, are spaced from each other at the top ends 19 thereof by a distance somewhat larger than a length of one longitudinal side of the card 12, extend from the top ends 19 toward each other, bend on the way slantwise downwardly to approach each other, and then terminate at the bottom ends 20.

Each pair of slits 18 are formed as above-mentioned to thereby provide at the sheet 14 a card supporting portion 21 at the interior angle side of the slits 18, whereby the card 12 inserted from above into the slits 18 is held at both sides in a sandwiching manner between the core 16 and the supporting portion 21.

At each slit 18, a vertical interval between the one end 19 and the other end 20 is set smaller than a width of the card 12, so that when the card 12 is inserted into the case 11 until the card 12 abuts at the lower edge against the other end 20, the upper edge of the card 12 projects somewhat upwardly from the upper end of each slit 18 , the projection being utilized to enable the card 12 to be easily slipped in or out of the card holder 13.

The vertical interval between the respective pairs of slits 18 is set not to overlap the cards with each other when held by the pairs of slits 18, and above each pair of slits 18 is provided a retaining tongue 23 formed by an about semicircular slit 22.

The retaining tongue 23, as shown in FIGS. 1 and 3, is pulled out upwardly frontwise of the card 12 after the card is inserted into each pair of slits 18, thereby locking the card.

In the drawings, each support portion 21 formed by each of the pair of slits 18 is provided at the bent portion thereof with a slanted cutout 24 by which the slit 18 is open ia part, thereby facilitating the insertion of the card 12 into the slits 18.

The first embodiment of the card holder 13 is constructed as above-mentioned, wherein the cards 12 are inserted into the pairs of slits 18 at the inner surface of both the bases 11 to enable a plurality of cards 12 to be arranged vertically in good order. Also, the sheet 14 is made transparent to enable the cards 12 to be distinguished as to the kinds and the patterns of the cards as they are housed in the card holder 13.

Figure 4:
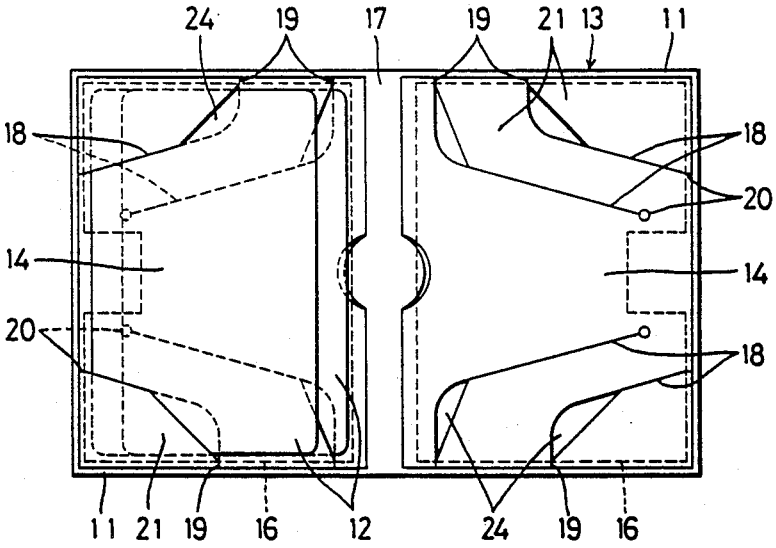
FIG. 4 is a front view of a second embodiment of the card holder of the invention in its opened condition.
Figure 5:
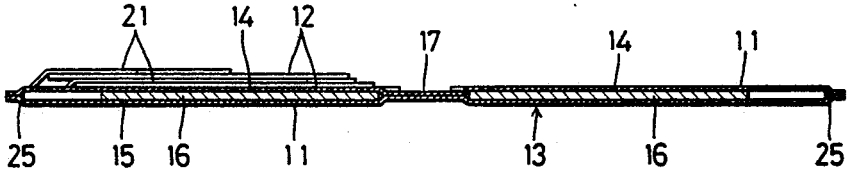
FIG. 5 is a sectional view taken transversely through the second embodiment.

Next, a second embodiment of the card holder of the invention is shown in FIGS. 4 and 5, which is a pocket version convenient to carry the cards 12 by a user. In FIGS. 4 and 5, the components are the same as those in the first embodiment and are designated by the same reference numerals.

In the second embodiment, at the inner surface of an outer sheet 15 foldable into two and at both sides of the central bending portion 17 are provided internal sheets 14 overlapping with the sheet 15, both the sheets 14 and 15 being high-frequency welded at the peripheral edges of the sheets 14 except for the edges opposite to each other. thereby forming pocket 25 between the outer sheet 15 and the inner sheets 14. Cores 16, such as cardboards, are interposed into the pockets 25 so that the outer sheet 15, inner sheet 14 and cores 16, form plate-like bases 11 respectively.

Two pairs of slits 18 the same as described in the first embodiment are provided at each inner sheet 14 close to each other as shown in FIG. 4, thereby housing in the card holder 13 two cards 12 in a partially overlapping manner.

The card holder 13 in FIG. 4 houses therein four cards 12 in total which are inserted freely by slipping the cards in or out of the slits 18 at the inside of bases 11, thereby enabling them to be carried.

Figure 6:
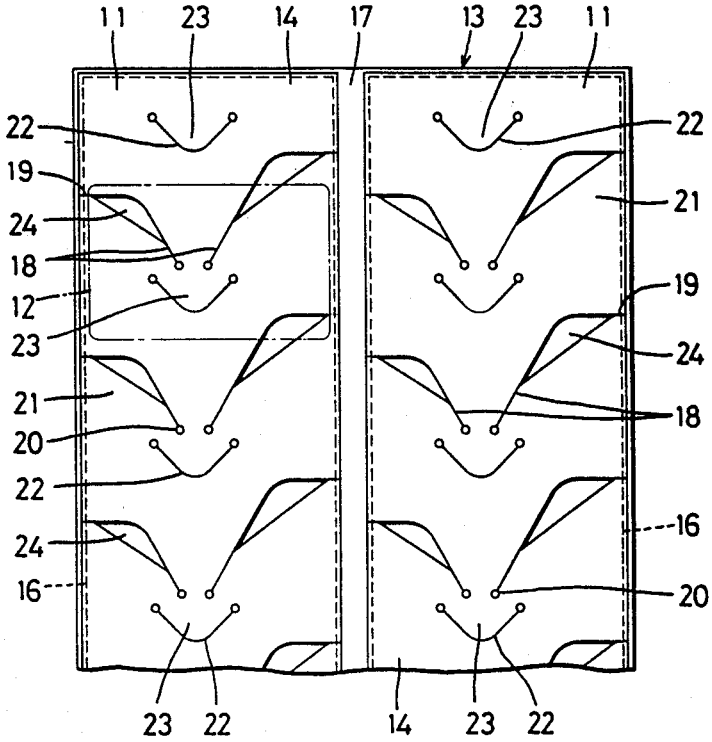
FIG. 6 is a front view of an alternate embodiment showing different slits provided on a plate-like base.

In FIG. 6, another example of slits 18 provided at the sheet 14 is shown, in which each pair of slits 18 are different in height at the upper ends so that the card is inserted firstly at one end into the higher slit end of one slit 18 and then at the other end into the lower slit end, thereby enabling smooth insertion of the cards 12.

Alternatively, one base material of large size may be provided with a large number of pairs of slits 18 so that the cards are pinned or hung for display.

Although several embodiments have been described, they are merely exemplary of the invention and not to be construed as limiting , the invention being defined solely by the appended claims.

What is claimed is:

1. A card holder for holding cards and the like, comprising:

two plate-like bases hinged together and moveable from an open to a folded position, the inside of said plate-like bases being formed of a transparent material and having provided thereon a plurality of pairs of opposing slits for inserting cards, said pairs of opposing slits being spaced vertically apart from each other at intervals slightly greater than the vertical height of the cards so that the cards do not overlap when inserted, whereby the entire faces of the inserted cards are visible without having to be removed, the top ends of each pair of opposing slits being spaced horizontally apart from each other at an interval slightly greater than the horizontal length of said cards, the top ends of each pair of opposing slits bending downwardly and inwardly, each pair of opposing slits extending downwardly and toward each other and terminating at opposite ends thereof, said opposite ends being spaced horizontally apart from each other at an interval less than the horizontal length of said cards, and at least one pair of opposing slits having one opposing slit which is different from the other opposing slit in vertical height at the top ends thereof.

2. A card holder according to claim 1, wherein a semicircular slit is provided above each of the pairs of slits which is openable upwardly and frontwardly, thereby allowing the top of the card to be held in place under the senmicircular slit after the card has been inserted in a pair of slits.

* * * * *